United States Patent [19]

Wiechert

[11] Patent Number: 5,011,310

[45] Date of Patent: Apr. 30, 1991

[54] INKED RIBBON CARTRIDGE WITH REMOVABLE CARRIER MEMBER

[75] Inventor: Edelbert Wiechert, Berlin, Fed. Rep. of Germany

[73] Assignee: Siemens Aktiengesellschaft, Berlin and Munich, Fed. Rep. of Germany

[21] Appl. No.: 396,924

[22] Filed: Aug. 22, 1989

[30] Foreign Application Priority Data

Aug. 26, 1988 [DE] Fed. Rep. of Germany ..... 3829445

[51] Int. Cl.[5] ..... B41J 35/28

[52] U.S. Cl. ..... 400/207; 400/692; 101/336

[58] Field of Search ..... 400/207, 208, 240.3, 400/242, 692; 101/336

[56] References Cited

U.S. PATENT DOCUMENTS 4,493,573 1/1985 Hashimoto et al. ..... 400/692 X
4,673,304 6/1987 Liu et al. ..... 400/208
4,702,631 10/1987 Watanabe ..... 400/208
4,754,290 1/1988 Kitayama et al. ..... 400/207 X
4,764,041 8/1988 Bierhoff ..... 400/208 X

FOREIGN PATENT DOCUMENTS 3619644 11/1986 Fed. Rep. of Germany ..... 400/692

*Primary Examiner*—Clifford D. Crowder
*Assistant Examiner*—Motilal P. Patel
*Attorney, Agent, or Firm*—Hill, Van Santen, Steadman & Simpson

[57] ABSTRACT

An inked ribbon cartridge having a cassette housing, a printing roller in a roller bracket, and a carrier member. The carrier member has an inked ribbon stored on two winding reels that lie parallel to the printing roller, and is separately removable from the cartridge. The cartridge has at least one locking mechanism with an actuation element to both unlock and remove the carrier member from the cassette housing. The carrier member also has a guard member preventing unintentional contact with the ribbon, and through which the printing roller extends.

4 Claims, 2 Drawing Sheets

INKED RIBBON CARTRIDGE WITH REMOVABLE CARRIER MEMBER

TECHNICAL FIELD

This invention relates to an inked ribbon cartridge for an image recording device.

BACKGROUND OF THE INVENTION

German published application 35 39 526 discloses an inked ribbon cartridge for an image recording means fashioned as a thermo transfer printer operating in parallel, whereby a line-shaped recording head is arranged inside a printer housing. The inked ribbon cartridge that can be introduced into the printer housing through a lateral opening in the direction along the recording head contains a printing roller and an inked ribbon on two winding reels parallel to the axis of the printing roller in a cassette housing. Since the printing roller and the winding reels are integral component parts of the inked ribbon cartridge, the cassette housing and the printing roller must automatically be replaced every time the inked ribbon is changed.

Co-pending U.S. patent application Ser. No. 07/209,892, the disclosure of which is incorporated by reference herein, teaches an inked ribbon cartridge wherein the winding reels for the inked ribbon are held in two bearing members. The winding reels are connected to form a replaceable unit that is introducible into the cassette housing, so that changing the ribbon does not necessarily require replacement of the entire inked ribbon cartridge, including the printing roller.

SUMMARY OF THE INVENTION

An important advantage of the inked ribbon cartridge of the present invention is in the simple replaceability of the inked ribbon. Only one manipulation operation is required for the removal of the inked ribbon, since the carrier member in the cassette housing is both unlocked and removed therefrom in a single step. The actuation elements also serve as gripping elements for holding the carrier member together with the winding reels, so that unintentional contact with the inked ribbon is practically impossible; this is particularly significant given the usual extremely thin and therefore correspondingly sensitive thermo transfer inked ribbons.

In a preferred embodiment of the inked ribbon cartridge of the invention, the carrier member is composed of two lateral parts that accept the winding reels at their axle ends and of a guard section that connects the lateral parts and includes a recess for the printing roller. One actuation element is arranged at each of the two lateral parts. As a result of the dual provision of the actuation elements, the carrier member together with the winding reels can be removed from the cassette housing in a simple way with both hands. The cassette housing is composed of a generally cubical box open at one side. This open side is closed by the guard section of the carrier member when the carrying member is inserted, so that unintentional contact with the inked ribbon on the winding reels is prevented when handling the inked ribbon cartridge.

A reliable and precisely placed locking of the carrier member together with the winding reels in the cassette housing is achieved by having the printing roller seated in the cassette housing between two retaining parts at which spring arms forming the lock mechanism are held with tabs at their ends. The carrier members include ramp channels having leading surfaces for guiding the tabs, and terminate in stop shoulders. The spring arms are deflected by the leading surfaces when the carrier member is inserted into the cassette housing, and the tabs resiliently engage behind the stop shoulders in the locked position. In addition to deflecting the spring arms, the leading surfaces also serve as guides for insertion of the carrier member into the cassette housing, so that damage to the inked ribbon on the winding reels (due, for example, to misalignment of the carrier member) is avoided.

For unlocking the carrier member in the cassette housing, the actuation elements are preferably take the form of resilient elements that have projections at their ends lying opposite the tabs. The projections are movable in the direction toward the barbs for the purpose of unlocking them. As a result of their formation as resilient elements, the actuation elements can be formed integrally with the carrier member as plastic injection molded parts in a way that is advantageous in terms of production engineering.

In combination with the formation of the actuation elements as bending elements, it is preferred that two bending elements are arranged at each lateral part of the carrier member and are movable toward one another perpendicularly to the removal direction of the carrier member from the cassette housing. For unlocking and removing the carrier member from the cassette housing, the pairs of bending elements lying at each side of the carrier member can be respectively grasped with thumb and index finger and can be pressed toward one another, whereby the carrier member is both unlocked and gripped with both hands between thumb and index finger for removal from the cassette housing. A further advantage of this feature is that a gap approximately only as wide as a finger is required between the lateral parts of the carrier member and the inside walls of the cassette housing that lie opposite them, in order to enable access to the actuation elements. Moreover, the formation of the lock mechanism in the form of spring arms with tabbed ends, in combination with the formation of the actuation elements as resilient elements for pressing the tabs back, makes it possible to fashion the actuation elements on the carrier member as close as possible to the connecting portion, so that one need not reach deeply into the gap between the lateral parts of the carrier member and the inside walls of the cassette housing to grasp the actuation elements. The gap can consequently be correspondingly narrow.

It is therefore a primary object of the present invention to provide an inked ribbon cartridge that has an easily and separately removable ribbon carrier member.

It is another object of the invention to provide an inked ribbon cartridge wherein accidental contact with the inked ribbon is prevented.

In attainment of the foregoing objects, this invention has an inked ribbon cartridge having a cassette housing, a printing roller in a roller bracket, and a carrier member. The carrier member has an inked ribbon stored on two winding reels that lie parallel to the printing roller. The cartridge has at least one lock mechanism with an actuation element to both unlock and remove the carrier member from the cassette housing. The carrier member also has a guard section preventing unintentional contact with the ribbon, and through which the printing roller extends.

These and other objects and advantages of this invention will become apparent upon reference to the accompanying description taken in conjunction with the following drawings.

DESCRIPTION OF THE PREFERRED EMBODIMENT

Figure 1:
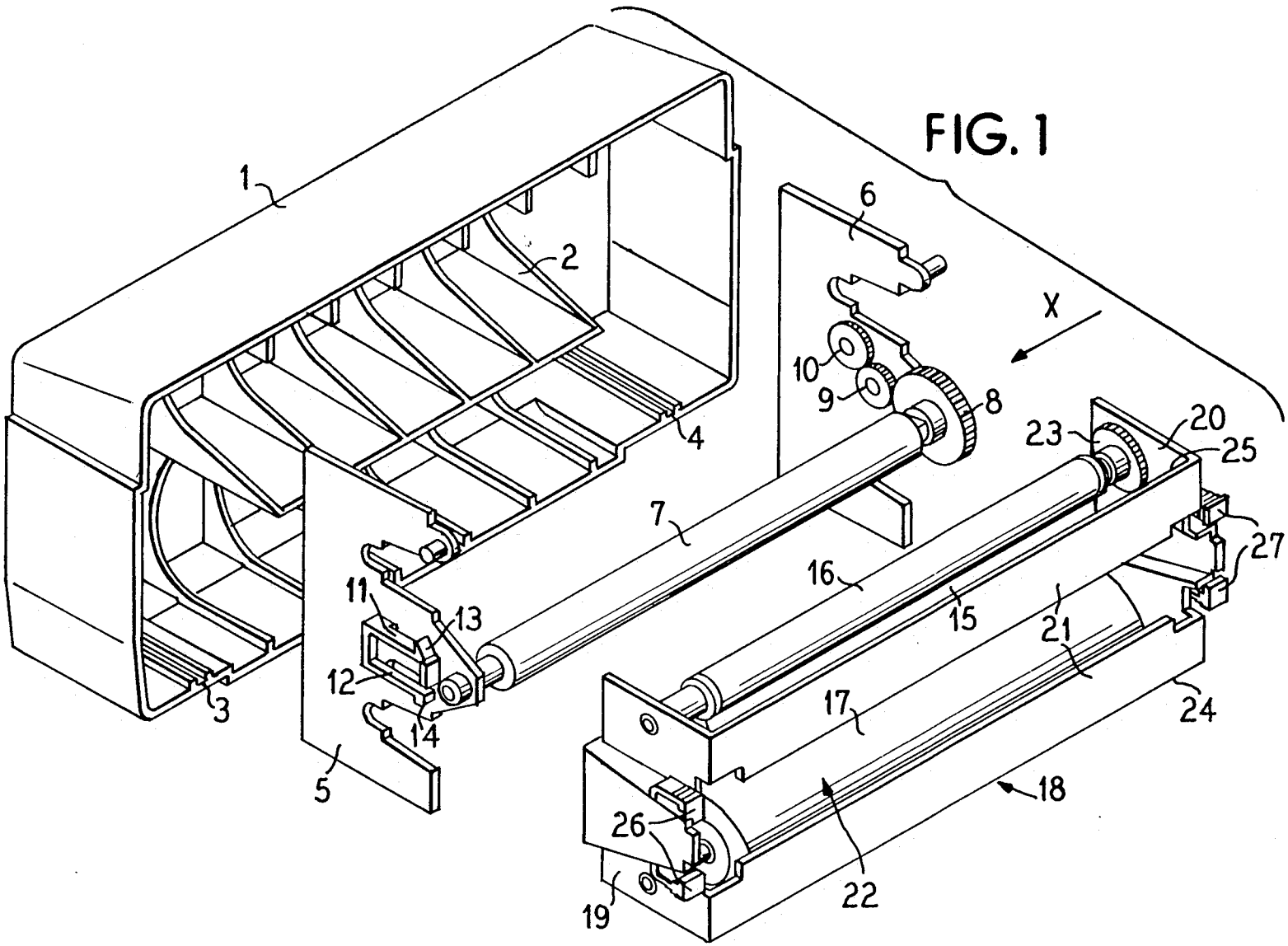
FIG. 1 is an exploded view of a preferred exemplary embodiment of the inked ribbon cartridge of the invention.

FIG. 1 shows an exemplary embodiment of the inked ribbon cartridge of the invention in exploded view for clarity. The inked ribbon cartridge is outwardly terminated by a cassette housing 1 that is composed of a cubical box that is open toward one side. Rib-shaped arcuate guide elements 2 are provided inside the cassette housing 1, and serve the purpose of guiding a recording sheet to be printed on, as shall be set forth in greater detail below. At its lower inside wall, the cassette housing 1 has channels 3 and 4 limited by guide ribs for the acceptance of a printing roller bracket including two retaining parts 5 and 6 between which a printing roller 7 is rotatably seated. In the region of its point of contact with the retaining part referenced 6, the printing roller 7 is connected to a drive gear 8 that meshes with two further gears 9 and 10. The two retaining parts 5 and 6 include elastic spring arms at their sides facing toward the inside walls of the cassette housing 1, these spring arms having tabs at their ends, and only the spring arms 11 and 12 together with their tabs 13 and 14 being visible in FIG. 1 at the retaining part 5. The retaining parts 5 and 6 for the printing roller 7 are shown outside the cassette housing 1 in FIG. 1 only for reasons for a clearer illustration; in their assembled operating position are fitted into the channels 3 and 4.

As a further component part of the inked ribbon cartridge, an inked ribbon 15 is stored on two winding reels 16 and 17 that are held at a common carrier member 18 with their axles parallel to one another. The carrier member 18 is composed of two lateral parts 19 and 20 that accept the winding reels 16 and 17 at their axle ends and that are connected to one another via a connecting guard member 21. Together with the winding reels 16 and 17, the carrier member 18 forms a replaceable unit that can be inserted into the cassette housing 1 of the inked ribbon cartridge, whereby—in operating position—the printing roller 7 partially looped by the section of the inked ribbon 15 lying between the winding reels 16 and 17 projects from a recess 22 in the connecting guard member 21. A gear wheel 23 is connected to the winding reel 16 via a friction clutch that meshes with the gear wheel 10 at the retaining part 6. The complete inked ribbon cartridge can be plugged into a printer (not shown) whereby the printing roller 7 together with the inking ribbon 15 lying thereagainst come to lie against a line-shaped recording head, for example a thermal printing head, that extends longitudinally relative to the printing roller 7. This is disclosed in detail in the initially cited co-pending application, and shall therefore be set forth only briefly below. For printing a recording sheet (not shown), the edge of this sheet is introduced into the inked ribbon cartridge in a gap between the lower edge 24 of the connecting part 21 and the wall of the cassette housing 1 and—being guided by the arcuate guide elements 2—thereby proceeds against the printing roller 7 whereby it is conducted past the recording head upon interposition of the inked ribbon 15, whereupon the sheet is printed. Next, the recording sheet proceeds along the guide elements 2 through the gap between the upper edge 25 of the connecting part 21 and the wall of the cassette housing 1, and in turn out of the inked ribbon cartridge.

Figure 2:
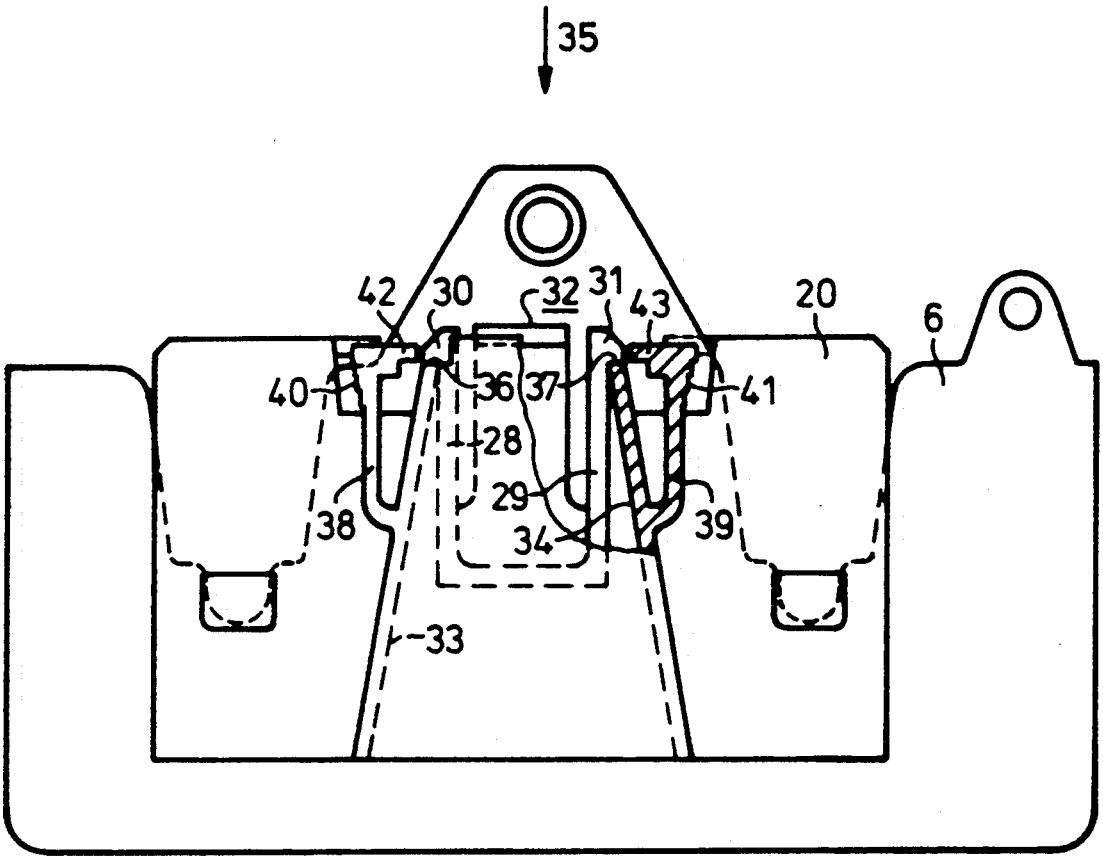
FIG. 2 a partial sectional view of the inked ribbon cartridge of FIG. 1 from the viewing direction referenced X.

As already set forth above, the carrier member 18 together with the winding reels 16 and 17 is insertable into and removable from the cassette housing 1 of the inked ribbon cartridge. The spring arms 11 and 12 together with their tabs 13 and 14 at the retaining part 5 and the corresponding spring arms with tabbed ends at the retaining part 6 (not visible in FIG. 1), form a lock mechanism for the carrier member 18. In order to be able simply to insert and lock the carrier member 18 together with the winding reels 16 and 17 into the cassette housing 1, or to unlock and remove the carrier from the cassette housing 1, the carrier member 18 has its two lateral parts 19 and 20 provided with actuation elements 26 and 27 for both lock actuation and gripping the carrier member 18. For a more detailed explanation of the actuation elements 26 and 27 and their interaction with the spring arms 11 and 12 and the tabs 13 and 14 thereof at the retaining part 5 of the corresponding spring arms at the retaining part 6, FIG. 2 shall be referenced below. FIG. 2 shows the carrier member 18 plugged onto the retaining parts 5 and 6 in a side view from the viewing direction referenced X in FIG. 1. For clarity, the printing roller 7 and the winding reels 16 and 17 have been omitted from FIG. 2, so that only the lateral part 20 the carrier member 18 and the retaining part are visible. The lateral part referenced 19 in FIG. 1 and the retaining part 5 are constructed similar to parts 20 and 6.

As FIG. 2 shows, two parallel spring arms 28 and 29 are held at the retaining part 6, the ends of these two parallel spring arms 28 and 29 being provided with tabs 30 and 31 that face away from one another and are outwardly directed. The spring arms 28 and 29 are connected by a plastic member 32 that is in turn secured to the retaining part 6. Each of the two lateral parts 19 and 20 of the carrier member 18 includes a ramp channel having two leading surfaces 33 and 34 for the tabs 30 and 31 at the spring arms 28 and 29. The leading surfaces 33 and 34 diverge in the direction referenced 35 for the introduction of the carrier member 18 into the cassette housing 1, have at their opposite ends stop shoulders 36 and 37. The tabs 30 and 31 slide along the leading surfaces 33 and 34 when the carrier member 18 is inserted into the cassette housing 1, whereby the spring arms 28 and 29 are deflected to an increasing degree and, finally, the tabs 30 and 31 snap into locking engagement behind the stop shoulders 36 and 37. This locked condition is shown in FIG. 2. In interaction with the tabs 30 and 31 elastically pressing against them, the leading surfaces 33 and 34 serve as guides for introduction of the carrier member 18 into the cassette housing 1, and as a result misalignment of the carrier member and damage to the inked ribbon 15 that could possibly result therefrom are avoided.

As FIG. 2 further shows with reference to lateral part 20, the actuation elements 26 and 27 at the two lateral parts 19 and 20 are each composed of two resilient elements 38 and 39 lying opposite one another that are integrally formed of plastic with the lateral part. The two resilient elements 38 and 39 are thereby fashioned such that, at the lateral part 20, the thumb and index finger of one hand can grasp them and press them toward one another at outwardly lying gripping locations 40 and 41, whereby projections 42 and 43 of the resilient elements 38 and 39 that lie opposite the tabs 30 and 31 force the tabs 30 and 31 out of engagement with the stop shoulders. The carrier member 18 can thus simply be unlocked in the cassette housing 1 and removed therefrom, since the resilient elements lying opposite one another at both sides of the carrier member 18 are pressed toward one another with thumb and index finger and thus provide a grip. The carrier member 18 is unlocked and is reliably and comfortably held for removal from one cassette housing 1 with both hands. For reliable gripping of the actuation elements 26 and 27 (or of the resilient elements 38 and 39) a gap that is approximately merely as wide as a finger is required between the lateral parts 19 and 20 of the carrier member and the inside walls of the cassette housing 1, so that a compact structure of the inked ribbon cartridge is achieved.

Although this invention has been illustrated and described in connection with a particular embodiment, it will become apparent to one of skill in the art that various changes may be made therein without departing from the scope and spirit of the invention as set forth in the appended claims.

I claim:

1. An inked ribbon cartridge for an image recording apparatus, said cartridge comprising the following:

a cassette housing;

a printing roller in a roller bracket in said housing, said printing roller having a longitudinal axis;

a carrier replaceable member insertable and lockable into, and removable from, said housing including an inked ribbon stored on two winding reels, said winding reels having respective longitudinal axes;

means for mounting said winding reels and said printing roller in said housing with their longitudinal axes parallel; and at least one lock mechanism having at least one actuation means, disposed on said carrier member, for both unlocking and gripping said carrier member for removing said carrier member from said cassette housing;

two lateral parts, each accepting an axle end of each winding reel;

a guard member connecting the lateral parts and provided with a longitudinal recess means for receiving the printing roller; and wherein said actuation means includes a pair of actuation elements, one of said pair arranged at each of the lateral parts.

2. An inked ribbon cartridge according to claim 1 and further wherein:

said roller bracket includes two retaining parts, one at each axle end of said printing roller;

each of said retaining parts carries a first portion of said lock mechanism, said portions including a pair of opposed spring arms, each having a first end rigidly attached to said retaining part, and a second end having a retaining tab;

each of said lateral parts of the carrier member carries a second portion of said lock mechanism, said second portions including ramp channels having leading surfaces ending in stop shoulders; and said carrier member is locked into said cassette housing by insertion of said spring arms into said ramp channels, and said spring arms are deflected by said leading surfaces until said tabs engage said stop shoulders.

3. An inked ribbon cartridge according to claim 2, further wherein said actuation elements include projection means mounted on resilient elements, each of said projection means being for engaging one of said tabs and moving it out of contact with its corresponding stop shoulder.

4. An inked ribbon cartridge according to claim 3, further wherein each of said actuation elements includes a pair of said resilient elements mounted on a lateral part of said carrier member, with each pair being movable toward each other transverse of a direction of removal of the carrier member out of the cassette housing.

* * * * *